US009394134B2

(12) United States Patent
Tamura et al.

(10) Patent No.: US 9,394,134 B2
(45) Date of Patent: Jul. 19, 2016

(54) IMAGE FORMING APPARATUS AND RECORDING MEDIUM STACKING APPARATUS

(71) Applicant: FUJI XEROX CO., LTD., Tokyo (JP)

(72) Inventors: Osamu Tamura, Kanagawa (JP); Yoshiyuki Takaishi, Kanagawa (JP); Ryuichi Sato, Kanagawa (JP); Noriyoshi Tsuchiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/678,425

(22) Filed: Apr. 3, 2015

(65) Prior Publication Data

US 2015/0210499 A1 Jul. 30, 2015

Related U.S. Application Data

(62) Division of application No. 12/702,113, filed on Feb. 8, 2010, now Pat. No. 9,042,806.

(30) Foreign Application Priority Data

Mar. 26, 2009 (JP) ..... 2009-076154

(51) Int. Cl.
*B65H 31/10* (2006.01)
*B65H 31/22* (2006.01)
(Continued)

(52) U.S. Cl.
CPC ..... *B65H 31/10* (2013.01); *B65H 29/50* (2013.01); *B65H 31/22* (2013.01); *B65H 43/06* (2013.01); *B65H 43/08* (2013.01); *G03G 15/6505* (2013.01); *B65H 2301/4225* (2013.01); *B65H 2405/15* (2013.01); *B65H 2511/10* (2013.01); *B65H 2511/30* (2013.01);
(Continued)

(58) Field of Classification Search
CPC ..... B65H 2405/15; B65H 31/06; B65H 2301/42254; B65H 2301/4225; B65H 2301/422542; B65H 31/08; B65H 31/22; B65H 31/10
See application file for complete search history.

(56) References Cited

U.S. PATENT DOCUMENTS 4,504,053 A * 3/1985 Shiozawa ..... B65H 1/14 271/157
5,096,181 A * 3/1992 Menon ..... B65H 1/266 271/147
5,172,906 A * 12/1992 Dole ..... 271/215
(Continued)

FOREIGN PATENT DOCUMENTS

JP 11-48596 A 2/1999

*Primary Examiner* — Jennifer Simmons
(74) *Attorney, Agent, or Firm* — Sughrue Mion, PLLC

(57) ABSTRACT

An image forming apparatus includes an image forming unit that forms an image on a recording medium; a recording medium stacking unit including a stacking member having a stacking surface on which the recording medium having the image formed by the image forming unit is stacked, an outside member that is located at the outside of the stacking surface so as to extend in a substantially vertical direction to the stacking surface and detachably mounted in the recording medium stacking unit, and a support member having a support portion that supports the stacking member; an outside member recognizing unit that recognizes whether the outside member is mounted on the recording medium stacking unit, or not; and a controller that controls one of a maximum number of recording media to be stacked and a maximum height of stack of recording media in the recording medium stacking unit according to whether the outside member recognizing unit recognizes that the outside member is mounted, or not.

5 Claims, 10 Drawing Sheets

(51) Int. Cl.

| | |
|---|---|
| ***B65H 43/08*** | (2006.01) |
| ***G03G 15/00*** | (2006.01) |
| ***B65H 29/50*** | (2006.01) |
| ***B65H 43/06*** | (2006.01) |

(52) U.S. Cl.
CPC ..... *B65H 2511/414* (2013.01); *B65H 2511/51* (2013.01); *B65H 2511/515* (2013.01); *B65H 2801/06* (2013.01)

(56) References Cited

U.S. PATENT DOCUMENTS

| | | | | |
|---|---|---|---|---|
| 5,211,389 | A * | 5/1993 | Roch | B07C 1/025 271/207 |
| 5,390,907 | A | 2/1995 | Dole | |
| 6,735,414 | B2 | 5/2004 | Shiraishi et al. | |
| 2002/0140161 | A1 * | 10/2002 | Ries | B65H 31/22 271/207 |

* cited by examiner

IMAGE FORMING APPARATUS AND RECORDING MEDIUM STACKING APPARATUS

CROSS-REFERENCE TO RELATED APPLICATIONS

This application is a Divisional of U.S. patent application Ser. No. 12/702,113, filed on Feb. 8, 2010, which claims priority from Japanese Patent Application No. 2009-076154 filed Mar. 26, 2009, the contents of all of which are incorporated herein by reference in their entirety.

BACKGROUND

1. Technical Field

The present invention relates to an image forming apparatus and a recording medium stacking apparatus.

2. Related Art

An image forming apparatus that forms an image on a recording medium such as a sheet has been recently promoted to increase in image forming speed. In connection with the increase of the image forming speed, a sheet discharge speed after an image has been formed on the sheet has been also promoted to increase. As a result, an apparatus that can stack and carry a large number of discharged sheets has been proposed.

SUMMARY

According to an aspect of the invention, there is provided an image forming apparatus including: an image forming unit that forms an image on a recording medium; a recording medium stacking unit including a stacking member having a stacking surface on which the recording medium having the image formed by the image forming unit is stacked, an outside member that is located at the outside of the stacking surface so as to extend in a substantially vertical direction to the stacking surface and detachably mounted in the recording medium stacking unit, and a support member having a support portion that supports the stacking member; an outside member recognizing unit that recognizes whether the outside member is mounted on the recording medium stacking unit, or not; and a controller that controls one of a maximum number of recording media to be stacked and a maximum height of stack of recording media in the recording medium stacking unit according to whether the outside member recognizing unit recognizes the outside member or not.

BRIEF DESCRIPTION OF THE DRAWINGS

Exemplary embodiments of the present invention will be described in detail based on the following figures, wherein.

DETAILED DESCRIPTION

An exemplary embodiment according to the present invention will be described hereunder with reference to the accompanying drawings.

Figure 1:
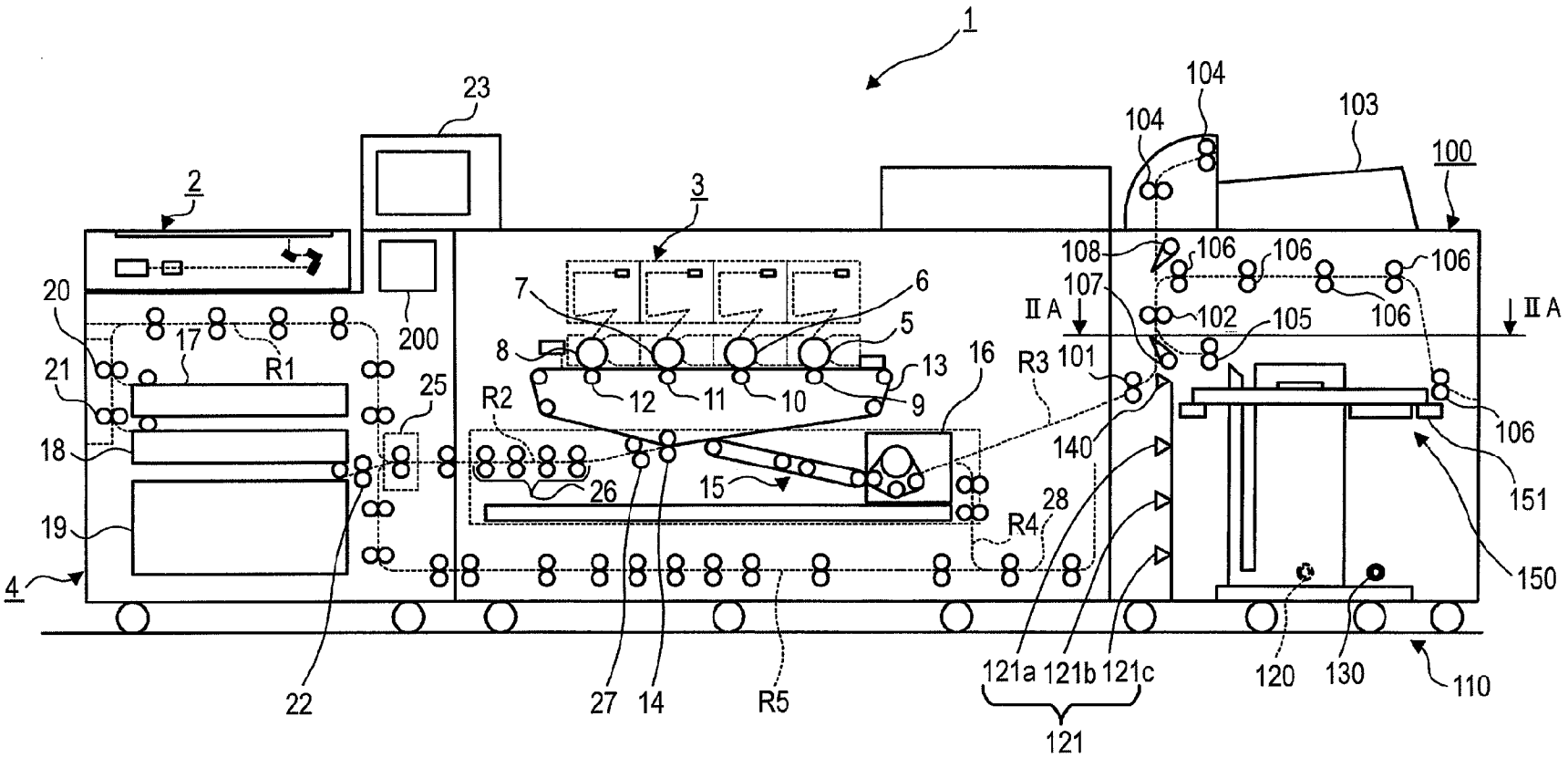
FIG. 1 is a diagram showing the configuration of an image forming apparatus according to an exemplary embodiment.

FIG. 1 is a schematic diagram showing an image forming apparatus 1 according to an exemplary embodiment of the present invention.

The image forming apparatus 1 has an image reader 2 for reading an image of a document, an image forming unit 3 for forming an image on a sheet as an example of a recording medium, a sheet feed unit 4 for feeding the sheet to the image forming unit 3, and a sheet stacking apparatus 100 for stacking the sheet having an image formed in the image forming unit 3. Furthermore, the image forming apparatus 1 has a controller 200 for collectively managing and controlling the operation of each part.

The image reader 2 has a transparent table on which the document is set (hereinafter referred to as "document mount table"), and reads an image of the document set on the document mount table. The image reader 2 further includes an optical scan system containing a lamp, a mirror, a carriage, etc. for optically scanning a document set on the document mount table, a lens system for focusing an optical image of the document scanned by the optical scan system, and an image reading sensor such as a CCD for receiving the optical image focused by the lens system and converting the received optical image to an electrical signal.

The image forming unit 3 includes four photosensitive drums 5, 6, 7 and 8 arranged in parallel in a horizontal direction in connection with respective colors of black (K), yellow (Y), magenta (M) and cyan (C), and four primary transfer rollers 9, 10, 11, and 12 disposed so as to correspond to the photosensitive drums 5 to 8, respectively. Furthermore, the image forming unit 3 includes an intermediate transfer belt 13 onto which toner images formed on the respective photosensitive drums 5 to 8 are successively primarily transferred, thereby forming superposed toner images on the intermediate transfer belt 13, and a secondary transfer roller 14 for secondarily transferring the superposed toner images onto a sheet to form a final toner image on the sheet. The image forming unit 3 further includes a vacuum transporting device 15 for transporting the secondarily transferred sheet, and a fixing unit 16 for fixing the toner image transferred onto the sheet.

A charger for uniformly charging the surface of each photosensitive drum (5 to 8), and a laser writing device for applying a laser beam to the surface of each photosensitive drum (5 to 8) charged by the charger to form an electrostatic latent image are disposed around the corresponding photosensitive drum (5 to 8). Furthermore, a developing unit for developing the electrostatic latent image formed on each photosensitive drum (5 to 8) with a predetermined color component toner to visualize the electrostatic latent image, a cleaner for removing residual toner remaining on the surface of the each photosensitive drum after the primary transfer has been conducted is disposed around the corresponding photosensitive drum (5 to 8).

Each of the primary transfer rollers 8 to 12 is disposed in the vicinity of the corresponding photosensitive drum (5 to 8)

so as to confront the corresponding photosensitive drum through the intermediate transfer belt 13. As described above, the primary transfer rollers 9 to 12 serve to primarily transfer the toner images formed on the corresponding photosensitive drums 5 to 8 onto the intermediate transfer belt 13. The intermediate transfer belt 13 is stretched in a loop by plural (five in this exemplary embodiment) support rollers.

The secondary transfer roller 14 is opposed to the intermediate transfer belt 13. The secondary transfer roller 14 serves to secondarily transfer (batch-transfer), onto the sheet (not shown), the superposed tone images of the respective colors that have been successively primarily transferred onto the intermediate transfer belts 13, thereby forming the final toner image on the sheet. This secondary transfer position corresponds to an image forming position of the image forming unit 3. The vacuum transporting device 15 transports to the fixing unit 16 the sheet having the final toner image transferred thereto by the secondary transfer roller 14 while sucking the sheet. The fixing unit 16 fixes the final toner image onto the sheet under heating and pressure, or the like.

The sheet feed unit 4 transports various kinds of sheets (not shown) accommodated in a first tray 17, a second tray 18 and a third tray 19 along respective predetermined transporting paths. Each of feed rollers 20, 21 and 22 are located in the vicinity of each of the corresponding trays 17 to 19. Each feed roller (20 to 22) nips a sheet which is separated and taken out from the corresponding tray (17 to 19) one by one, and temporarily stops the sheet on a sheet transporting path. Furthermore, each feed roller (20 to 22) feeds the sheet to the downstream side in a sheet transporting direction at a timing based on a predetermined start signal.

An operation panel 23 is provided in the vicinity of the image reader 2 as an example of an accepting unit operated by a user. The operation panel 23 is a touch panel display, and displays an operation menu to accept an operation instruction of a processing request or the like from a user and displays selection information for the user, an operating condition of the apparatus, etc.

Plural transporting rollers for transporting the sheet are disposed in a series of sheet transporting paths R1 to R5 extending from the sheet feed position of each of the feed rollers 20 to 22 through the image forming position of the image forming unit 3 to the sheet stacking apparatus 100. Sheets accommodated in the first tray 17 are fed out by the feed roller 20, passed through the first sheet transporting path R1 and then fed into a joint transporting unit 25. Sheets accommodated in the second tray 18 are fed by the feed roller 21, passed through the first sheet transporting path R1 and then fed into the joint transporting unit 25. Sheets accommodated in the third tray 19 are directly fed into the joint transporting unit 25 by the feed roller 22.

The sheet fed into the joint transporting unit 25 is passed through the second sheet transporting path R2 and fed to the image forming position of the image forming unit 3. Furthermore, the sheet passed through the image forming position is fed to the fixing unit 16 by the vacuum transporting unit 15, passed through the third sheet transporting path R3 and then discharged to the sheet stacking apparatus 100. Furthermore, with respect to the sheet having images formed on both the sides thereof, the sheet is passed through the fixing unit 16 and then the fourth sheet transporting path R4, and then fed into a sheet reversing unit 28 so that both the sides of the sheet are reversed to each other. Thereafter, the sheet is passed through the fifth sheet transporting path R5, and then fed into the joint transporting unit 25 again.

With respect to the sheet transporting paths R1 to R5, a position correcting unit 26 and a registration roll 27 are disposed in the second sheet transporting path R2. The position correcting unit 26 corrects the position of sheet transported along the second sheet transporting path R2. The registration roll 27 is constructed by a pair of rolls that are in contact with each other under pressure. The sheet is transported to the image forming position by rotating the paired rolls while the sheet is nipped between the paired rolls. When the sheet is transported by the registration roll 27, the arrival timing of the sheet for the image forming processing is adjusted by a timing adjusting mechanism (not shown).

The sheet transport in the image forming apparatus 1 is executed by using a center registration system in which the center portion (center) of the sheet in a direction perpendicular to the sheet transporting direction is set as a reference position irrespective of a size of the sheet.

The sheet stacking apparatus 100 has an entrance roller 101 for guiding the sheet transported from the image forming unit 3 into the apparatus 100, and a reversing roller 102 for transporting the sheet while nipping the sheet transported from the entrance roller 101 and reversing the sheet in a switchback style as occasion demands.

The sheet stacking apparatus 100 has a transporting roller 104 for transporting the sheet transported from the reversing roller 102 to a top tray 103 provided on the upper surface of the apparatus, and a discharge roller 105 for discharging the sheet reversed by the reversing roller 102 to a large-capacity sheet stacking unit 110 described later.

Furthermore, the sheet stacking apparatus 100 has a transporting roller 106 for transporting the sheet transported from the entrance roller 101 to a device connected to the downstream side of the sheet stacking apparatus 100.

A switching gate 107 is provided below the reversing roller 102 to switch the travelling direction of the sheet so that the sheet transported from the entrance roller 101 is led to the reversing roller 102 or the sheet reversed by the reversing roller 102 is led to the discharge roller 105. Furthermore, a switching gate 108 is provided above the reversing roller 102 to switch the traveling direction of the sheet to lead the sheet transported from the reversing roller 102 to the transporting roller 104 or the transporting roller 106.

Next, the large-capacity sheet stacking unit 110 will be described.

The large-capacity sheet stacking unit 110 is configured to move up and down a sheet stacking surface. The sheet stacking surface is gradually moved downward as the sheet is stacked, and also the sheet stacking surface is also moved downwardly when a sheet take-out instruction is made. The sheet stacking surface is moved up and down by an elevator device 150 described later.

Figure 2A:
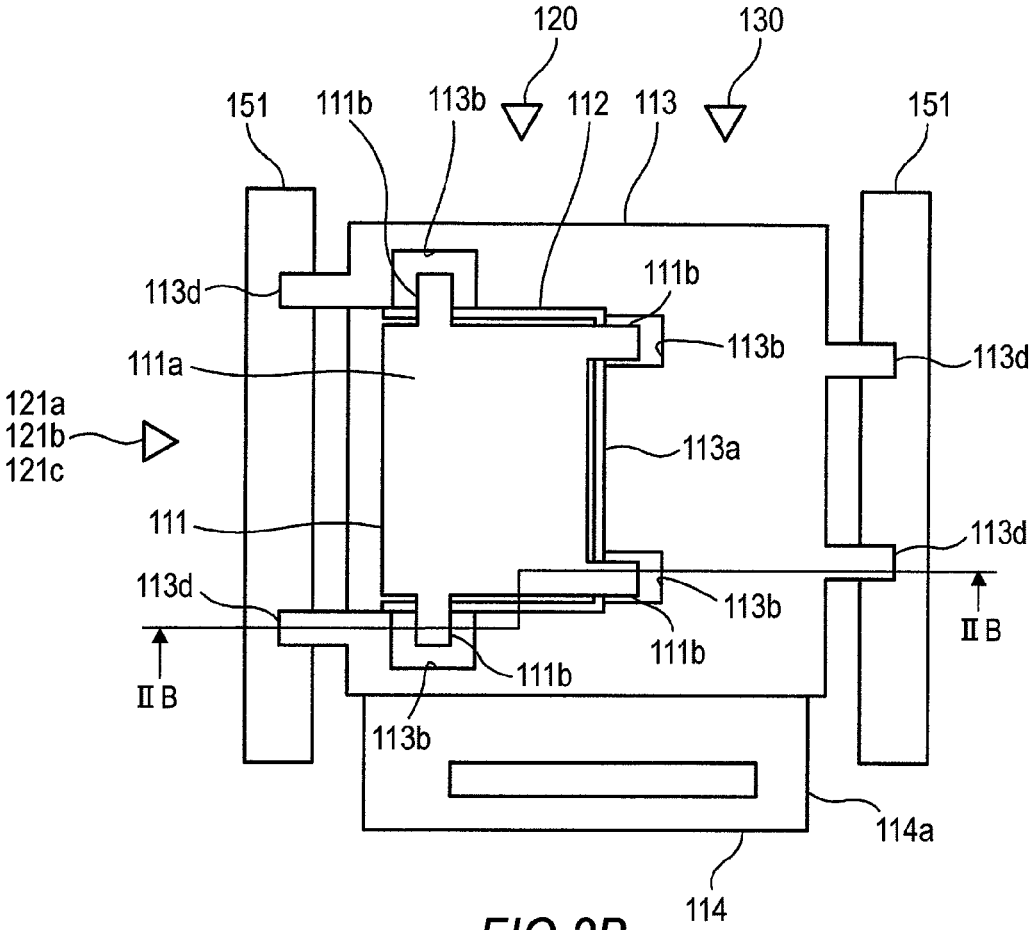
FIGS. 2A and 2B are diagrams showing the configuration of a large-capacity stacking unit.
Figure 2B:
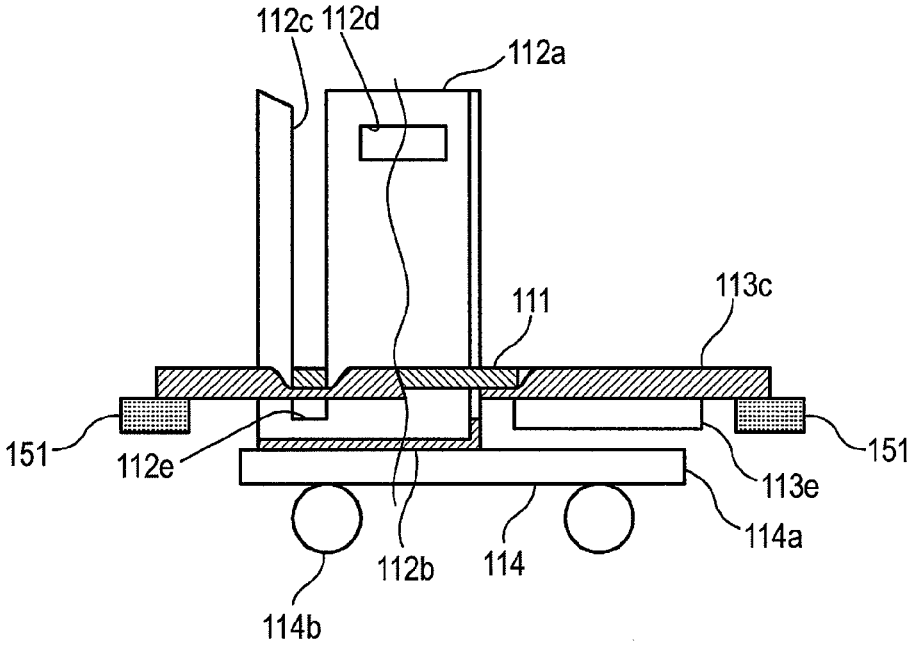
Figure 3:
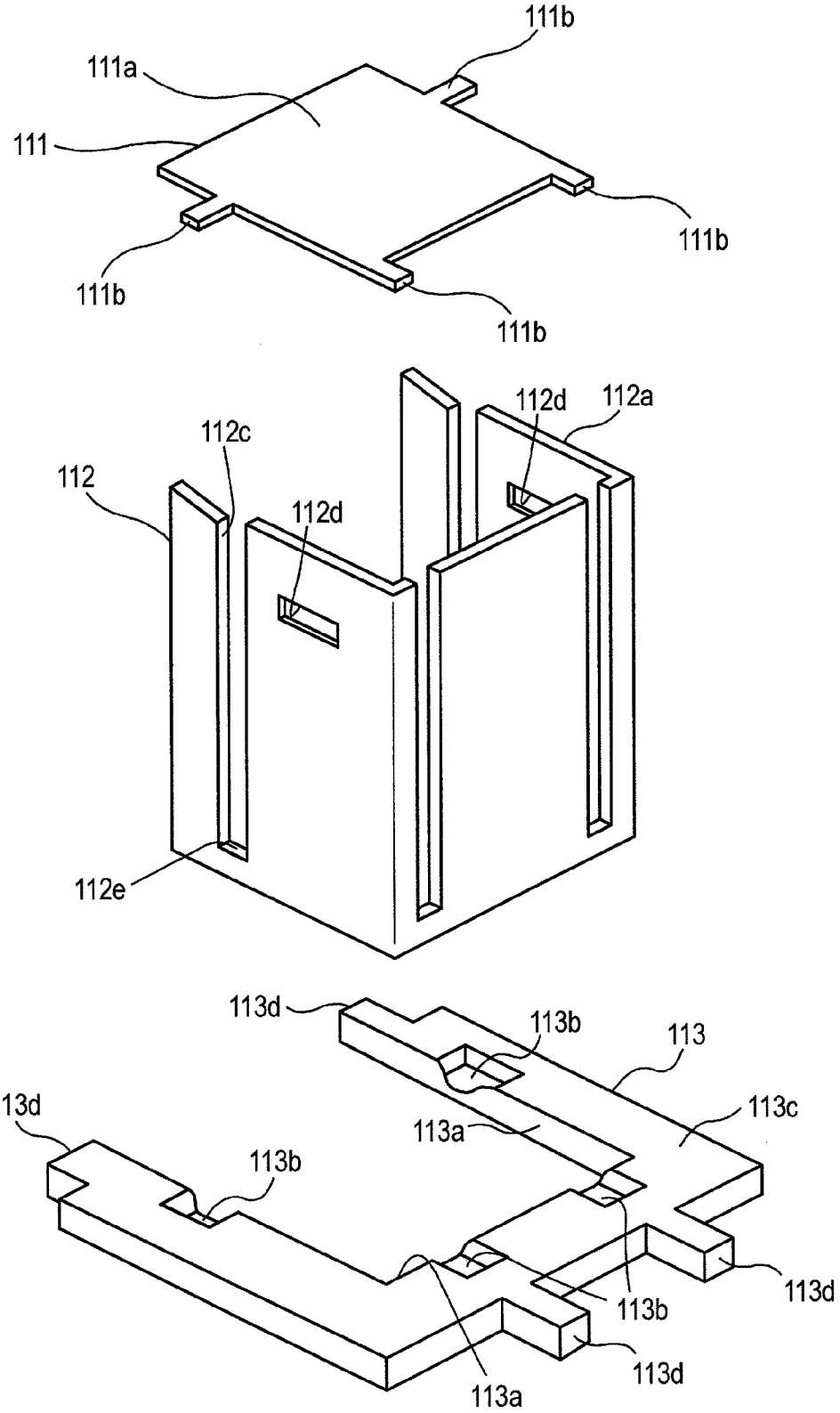
FIG. 3 is a perspective view showing a stacking member, a container frame, and a support member.

FIGS. 2A and 2B are diagrams showing the configuration of the large-capacity sheet stacking unit 110. FIG. 2A is a cross-sectional view taken along a line IIA-IIA of FIG. 1 (the discharge roller 105, the switching gate 107, etc. are not shown to make the configuration of the large-capacity sheet stacking unit 110 easily understandable), and FIG. 2B is a cross-sectional view taken along a line IIB-IIB of FIG. 2A. FIG. 3 is a perspective view showing a sheet stacking member 111, a container frame 112 and a support member 113.

The large-capacity sheet stacking unit 110 includes the sheet stacking member 111 having a sheet stacking surface 111*a* on which the sheet is stacked, and the container frame 112 that is located at the outside of the sheet stacking surface 111*a* of the sheet stacking member 111, and restricts movement of the sheet stacked on the sheet stacking surface 111*a*. The large-capacity sheet stacking unit 110 has the support member 113 that restricts movement of the container frame 112 and also is moved up and down by the elevator device 150 while supporting the sheet stacking member 111.

The container frame 112 is mounted on a carriage 114 having casters 114*b* attached to the lower portion of a pallet 114*a*, and the sheet stacking member 111 is accommodated in the sheet stacking apparatus 100 while mounted on the support member 111.

The sheet stacking member 111 has the sheet stacking surface 111*a* on which the sheets are stacked, and extension portions 111*b* extending from the sheet stacking surface 111*a* in parallel to the sheet stacking surface 111*a*. The plural (four in this exemplary embodiment) extension portions 111*b* are provided so that plural extension portions 111*b* (two in this exemplary embodiment) extend from the sheet stacking surface in the sheet transporting direction and plural (the other two) extension portions 111*b* extend from the sheet stacking surface in the direction perpendicular to the sheet transporting direction. The sheet stacking member 111 of this exemplary embodiment is a plate-shaped member, and the sheet stacking surface 111*a* and the extension portions 111*b* are formed integrally with one another. Therefore, no boundary exists between the sheet stacking surface 111*a* and each extension portion 111*b*, and thus no boundary is shown.

The container frame 112 extends in a substantially vertical direction to the sheet stacking surface 111*a* of the sheet stacking member 111, and has a side wall 112*a* for regulating the movement of the sheet stacked on the sheet stacking surface 111*a*, and a bottom plate 112*b* which is in contact with a pallet 114*a* of the carriage 114. As shown in FIG. 2B, the side wall 112*a* is U-shaped when viewed from the upper side, and constructed by a wall for restricting the movement of the sheet in the sheet transporting direction and walls for restricting the movement of the sheet in the direction perpendicular to the sheet transporting direction. The side wall 112*a* is provided with incisions 112*c* in which the extension portions 111*b* of the sheet stacking member 111 are fit so that the up-and-down movement of the sheet stacking member 111 is allowed. The incisions 112*c* are formed at the positions corresponding to the extension portions 111*b*.

The container frame 112 is provided with grip portions 112*d* with which a user can easily carry the container frame 112. In this exemplary embodiment, the grip portions 112*d* are two holes formed in the side walls 112*a* opposed to each other in the direction perpendicular to the sheet transporting direction. The user can lift up the container frame 112 from the carriage 114 by putting his/her hands in the grip portions 112*d*. At this time, the end faces 112*e* of the lowermost ends of the incisions 112*c* function as supporters for supporting the extension portions 111*b* of the sheet stacking member 111, and at the same time the sheet stacking member 111 is lifted up, so that the sheets stacked on the sheet stacking member 111 can be also carried.

Figure 4A:
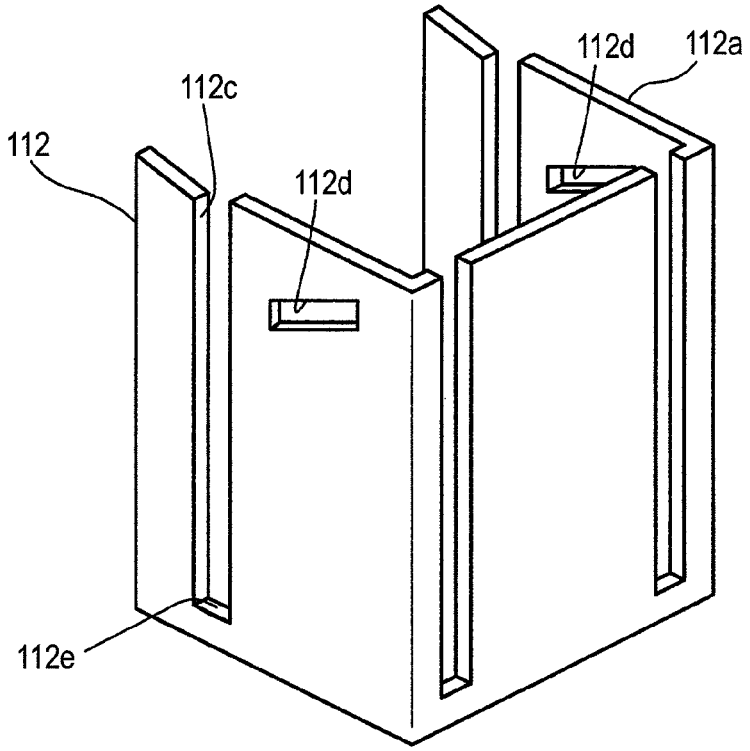
FIGS. 4A and 4B are perspective and side views showing another shape of the container frame.
Figure 4B:
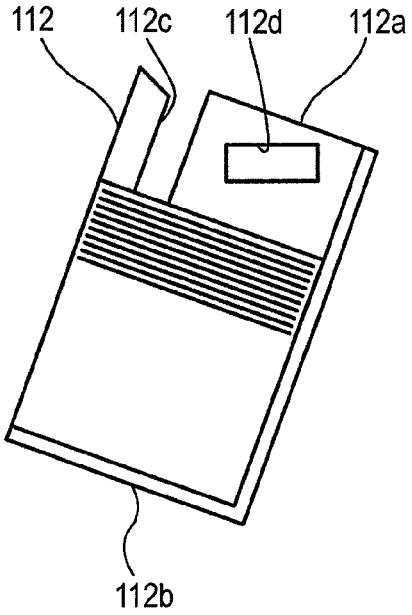

FIGS. 4A and 4B are perspective and side views showing another shape of the container frame 112. As shown in FIG. 4A, the grid portions 112*d* may be inclined at some angle to the bottom plate 112*b*. By designing the container frame 112 as described above, stacked sheets can be easily carried while the container frame 112 is inclined as shown in FIG. 4B to make the stacked sheets abut against the side wall 112*a* in the sheet transporting direction. The bottom plate 112*b* is not an indispensable component, and the sheet can be carried without providing the bottom plate 112*b*.

The support member 113 has a restricting unit 113*a* for restricting the movement of the container frame 112, and recessed portions 113*b* serving as supporters for supporting the extension portions 111*b* of the sheet stacking member 111. The support member 113 is basically formed as a plate-shaped member, and the recessed portion 113*b* is concaved from the upper surface 113*c* thereof. The recessed portions 113*b* are formed at the positions corresponding to the extension portions 111*b*, and the number of the recessed portions 113*b* is equal to that of the extension portions 111*b*. Accordingly, the support member 113 can restrict the movement of the sheet stacking member 111.

Furthermore, the sheet stacking member 111 is designed as a plate-shaped member, and thus when the container frame 112 is not installed, the sheets can be stacked beyond the area of the sheet stacking surface 111*a* of the sheet stacking member 111 under a state where the sheet stacking member 111 is supported on the support member 113. In this case, the degree of freedom of the size of the stackable sheet is increased as compared with the case where the container frame 12 is installed. That is, when the container frame 112 is installed, the movement of the sheet is restricted by the container frame 112. However, when the container frame 112 is not installed, the sheet is movable without being restricted by the container frame 112. Therefore, the degree of freedom of the size of the stackable sheet can be increased.

A site for restricting the movement of the container frame 112 may be provided to the pallet 114*a* of the carriage 114 in place of the restricting unit 113*a*.

The support member 113 has plural (four in this exemplary embodiment) extension portions 113*d* extending to the upstream and downstream sides in the sheet transporting direction. When elevator arms 151 of the elevator device 150 are located at the outside of the outer shape of the pallet 114*a* of the carriage 114 in top view, the elevator arms 151 support the extension portions 113*d*, whereby the support member 113 can be lifted up. Furthermore, the support member 113 has a contact portion 113*e* which comes into contact with the pallet 114*a* of the carriage 114.

The elevator device 150 has the elevator arms 151, and an elevating mechanism (not shown) for moving the elevator arms 151 up and down. Various kinds of well-known elevating mechanisms may be used as the elevating mechanism. For example, the up-and-down movement of the elevator arms 151 can be implemented by attaching the elevator arm 151 through a slider to a guide rail provided in the vertical direction in the sheet stacking apparatus 100 and using a driving transmission mechanism for converting the rotating power of a motor to a linear motion in the vertical direction of the slider.

Figure 5A:
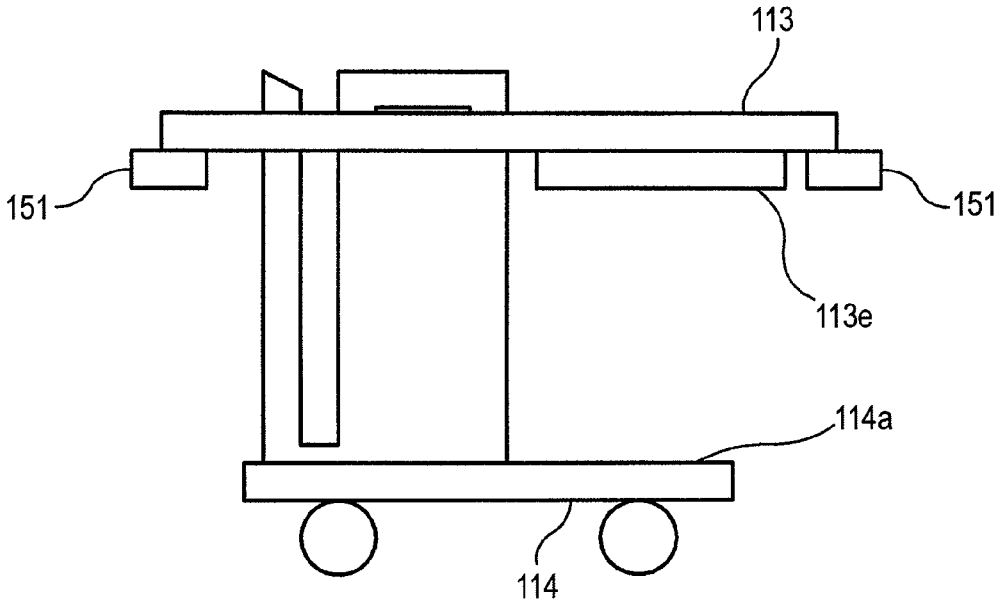
FIGS. 5A and 5B are diagrams showing an elevation state of an elevator arm of an elevator apparatus.
Figure 5B:
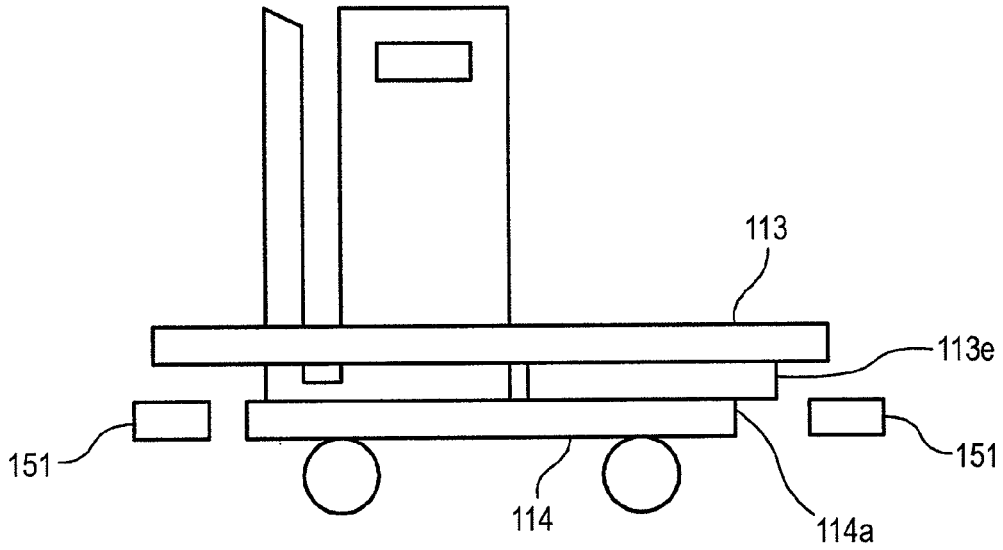

FIGS. 5A and 5B are diagrams showing an elevation state of the elevator arms 151 of the elevator device 150. FIG. 5A shows a state in which the elevator arms 151 of the elevator device 150 move up to the uppermost position, and FIG. 5B shows a state in which the elevator arms 151 of the elevator device 150 move down to the lowermost position. The elevator arms 151 moves up and down in a range shown in FIGS. 5A and 5B. Under the state where the elevator arms 151 move down to the lowermost position as shown in FIG. 5B, the contact portion 113*e* of the support member 113 comes into contact with the pallet 114*a* of the carriage 114 to thus stop the support member 113. The carriage 114 is taken out from the inside of the sheet stacking apparatus 100 to the outside under the above state, whereby stacked sheets can be carried.

An upper sensor 140 (see FIG. 1) as an optical sensor is provided at the upper portion of the large-capacity sheet stacking unit 110, and the downward movement of the elevator arms 151 of the elevator device 150 is performed on the basis of a detecting operation of the upper sensor 140. The upper sensor 140 is a sensor for detecting that the upper face of the sheets stacked on the sheet stacking member 111 (i.e., the uppermost sheet of sheets stacked on the sheet stacking member 111) is located at a lower position than the height of the discharge roller 105 by a predetermined distance.

When no sheet is stacked on the sheet stacking member 111, the elevator device 150 makes the sheet stacking member 111 and the support member 113 on standby at the position shown in FIG. 5A. Upon start of sheet stacking on the sheet stacking member 111, the elevator device 150 moves the sheet stacking member 111 and the support member 113 downwardly by the distance corresponding to a predetermined height when the sheet located at the uppermost position out of a stack of the sheets is detected by the upper sensor 40.

Furthermore, in the large-capacity sheet stacking unit 110 thus configured, the sheet stacking member 111, the container frame 112, and the support member 113 are configured as independent members, and these members are separable from one another. Accordingly, the user can arbitrarily select whether the container frame 12 is used, or not. That is, the user can arbitrarily select whether the sheets are stacked on the sheet stacking member 111 supported on the support member 113 without mounting the container frame 112 on the carriage 114 or the sheets are stacked on the sheet stacking member 111 while the container frame 112 is mounted on the carriage 114.

The controller 200 may recognize whether the container frame 112 is provided, or not, and change the maximum number of stackable sheets or the stack height of sheets according to whether the container frame 112 is provided or not. Whether the container frame 112 is provided or not can be recognized on the basis of whether a container presence or absence detecting sensor 120 described later detects that the container frame 112 is provided or not. In this case, the container presence or absence detecting sensor 120 functions as an example of a recognizing unit for recognizing whether the container frame 112 is mounted or not.

In order to implement the control described above, the container presence or absence detecting sensor 120 as the optical sensor for detecting whether the container 112 is mounted or not is provided at the lower portion of the sheet stacking apparatus 100 (see FIGS. 1 and 2). Plural height detecting sensors 121 are provided so as to be arranged in the vertical direction of the sheet stacking apparatus 100 so that the height of the support member 113 and furthermore the number of stacked sheets or the stack height can be stepwise detected. For example, a first height detecting sensor 121*a* located at the uppermost position, a second height detecting sensor 121*b* located at the second uppermost position, and a third height detecting sensor 121*c* located at the lowermost position are arranged as shown in FIG. 1.

When the container frame 112 is provided to the large-capacity sheet stacking unit 110, it is expected that the user holds the container frame 112 by his/her hands to carry the stacked sheets. When the container frame 112 is not provided to the large-capacity sheet stacking unit 110, it is expected that the user carries the stacked sheets by using the carriage 114. Therefore, when the container frame 112 is provided to the large-capacity sheet stacking unit 110, the controller 200 may set the maximum number of stackable sheets in the sheet stacking apparatus 100 to a smaller number or reduce the maximum stackable sheet height to a lower height as compared with the case where the container frame 112 is not provided. Accordingly, when the container frame 112 is provided to the large-capacity sheet stacking unit 110, the weight of the stacked sheets is lighter and thus the container frame 112 can be easily carried by hands as compared with the case where the container frame 112 is not provided. On the other hand, when the stacked sheets are carried by the carriage 114, a larger number of sheets can be carried.

For example, in a case where the container presence or absence detecting sensor 120 detects existence of the container frame 112, the controller 200 stops the image forming operation, the sheet transporting operation and the sheet discharging operation (these operations are hereinafter collectively referred to as "image forming operation" in some cases) when the first height detecting sensor 121*a* detects the height of the support member 113. On the other hand, in a case where the container presence or absence detecting sensor 120 does not detect existence of the container frame 112, the controller 200 stops the image forming operation when the third height detecting sensor 121*c* detects the height of the support member 113.

Figure 6:
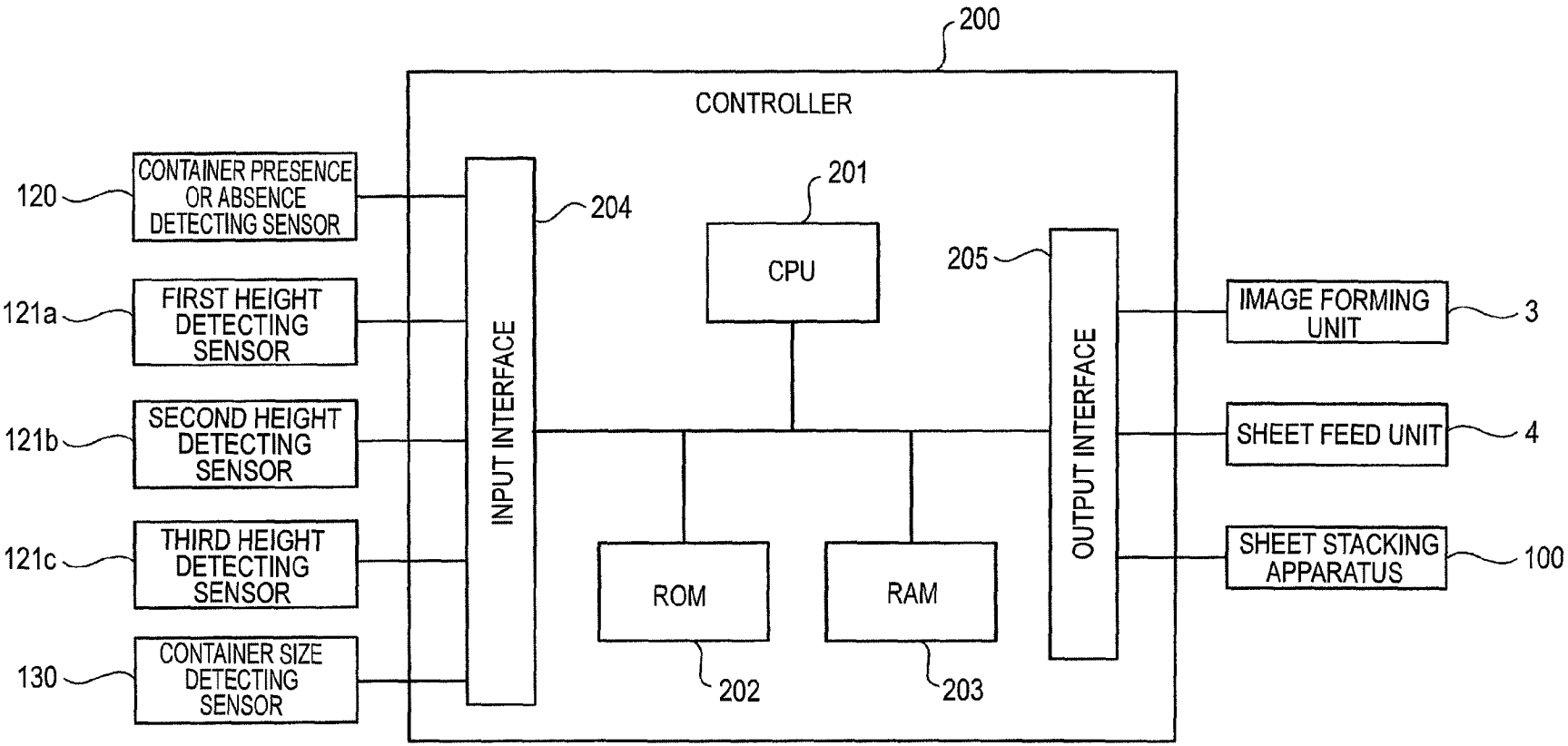
FIG. 6 is a block diagram showing a controller.

FIG. 6 is a block diagram of the controller 200.

As shown in FIG. 6, the controller 200 has a CPU 201, a ROM 202, a RAM 203, an input interface 204 and an output interface 205, and an image forming program, a sheet transporting program, a sheet stacking program, and the like are stored in ROM 202 in advance.

The controller 200 obtains signals from the container presence or absence detecting sensor 120, the first height detecting sensor 121*a*, the second height detecting sensor 121*b*, the third height detecting sensor 121*c*, etc. through an input interface 204 into the CPU 201. The CPU 201 executes a predetermined processing program, transmits predetermined control signals through an output interface 205 to the image forming unit 3, the sheet feed unit 4, the sheet stacking apparatus 100, etc. to control the respective control targets.

A procedure of the sheet stacking processing executed by the controller 200 will be hereunder described with reference to a flowchart of FIG. 7.

Figure 7:
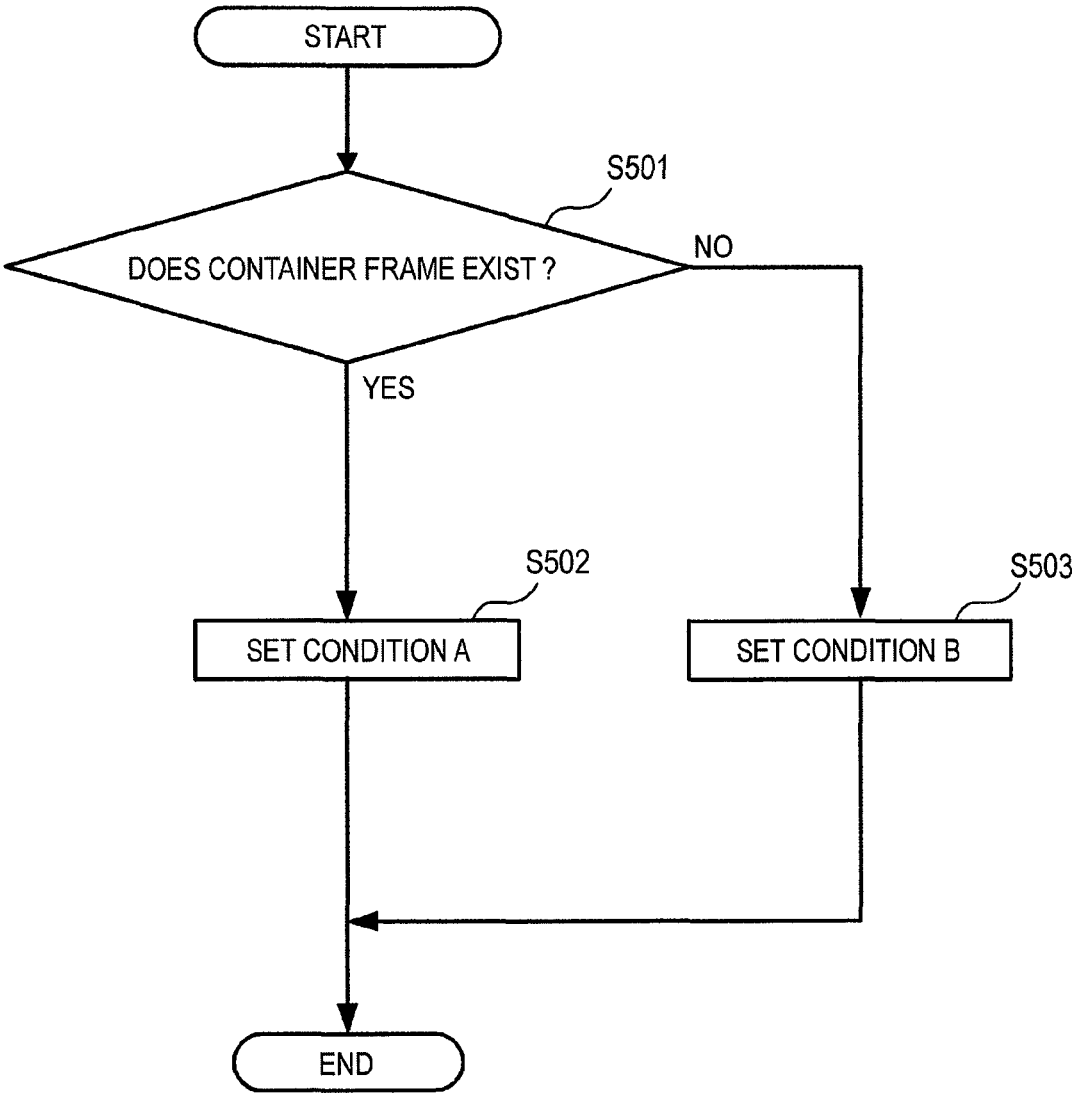
FIG. 7 is a flowchart showing a procedure of sheet stacking processing executed by the controller.

FIG. 7 is a flowchart showing the procedure of the sheet stacking processing executed by the controller 200. The controller 200 executes the sheet stacking processing in response to a trigger such as a request for executing the image forming operation, for example, by pushing a print start button.

The controller 200 determines, on the basis of a detection result of the container presence or absence detecting sensor 120, whether the container frame 112 exists or not (step 501). When existence of the container frame 112 is determined (i.e., "Yes") in step 501, the controller 200 sets a condition A as a sheet stacking finishing condition (step 502), and finishes the processing. On the other hand, when existence of the container frame 112 is not determined (i.e., "No") in step 501, the controller 200 sets a condition B as the sheet stacking finishing condition (step 503), and finishes the processing.

The condition A can indicate a situation in which the first height detecting sensor 121*a* detects the support member 113. Furthermore, the condition B can indicate a situation in which the third height detecting sensor 121*c* detects the support member 113.

As described above, the controller 200 sets the sheet stacking finishing condition on the basis of whether the container frame 112 is provided or not, whereby the sheets can be stacked in accordance with user's needs.

Furthermore, the controller 200 may change the maximum number of sheets to be continuously discharged to the large-capacity stacking unit 110 according to whether the container frame 112 is provided or not. For example, when the container presence or absence detecting sensor 120 detects existence of the container frame 112, the controller 200 sets the maximum number of sheets to be continuously discharged to the large-capacity stacking unit 110 to D (for example, 2,000 sheets). On the other hand, when the container presence or absence detecting sensor 120 does not detect existence of the container frame 112, the controller 200 sets the maximum number of sheets to be continuously discharged to the large-capacity stacking unit 110 to E (for example, 5,000 sheets).

In the case where the container presence or absence detecting sensor 120 detects existence of the container frame 112, the controller 200 stops the image forming operation when the number of sheets discharged continuously from the discharge roller 105 reaches D. On the other hand, in the case where the container presence or absence detecting sensor 120 does not detect existence of the container frame 112, the controller 200 stops the image forming operation when the number of sheets discharged continuously from the discharge roller 105 reaches E.

Alternatively, in such a situation where the user inputs the number of sheets from the operation panel 23, the controller 200 may limit the acceptable maximum number of sheets input from the operation panel 23 as follows. That is, when the container presence or absence detecting sensor 120 detects existence of the container frame 112, the controller 200 accepts only D or less (i.e., the acceptable upper limit number is equal to D). Furthermore, when the container presence or absence detecting sensor 120 does not detect existence of the container frame 112, the controller 200 accepts only E or less (i.e., the acceptable upper limit number is equal to E).

Figure 8A:
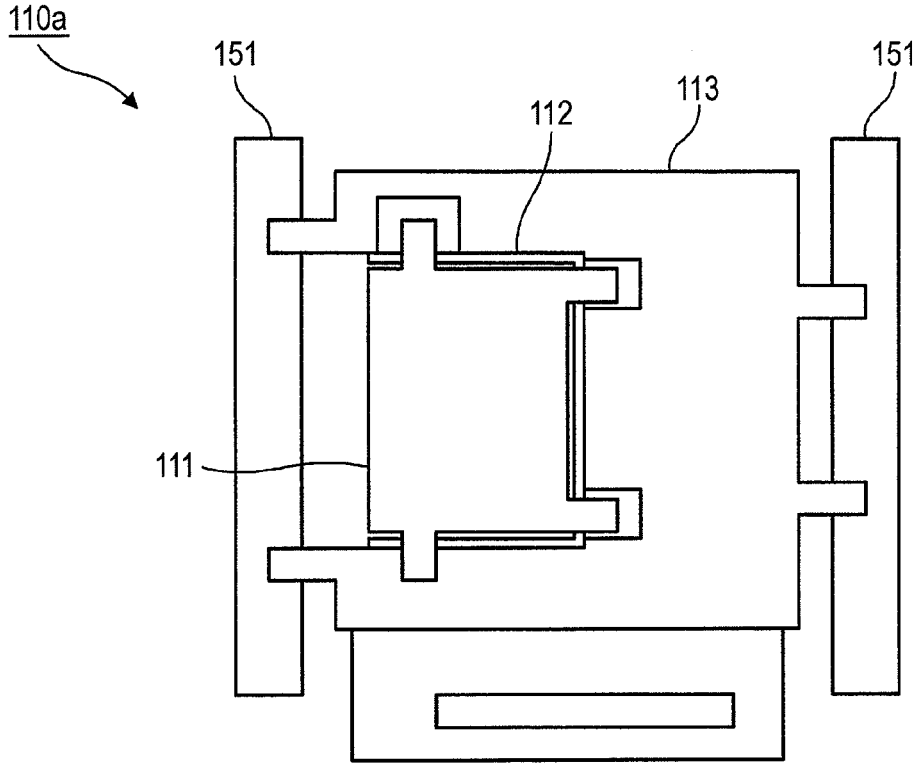
FIGS. 8A and 8B are diagrams showing variations of the large-capacity stacking unit.
Figure 8B:
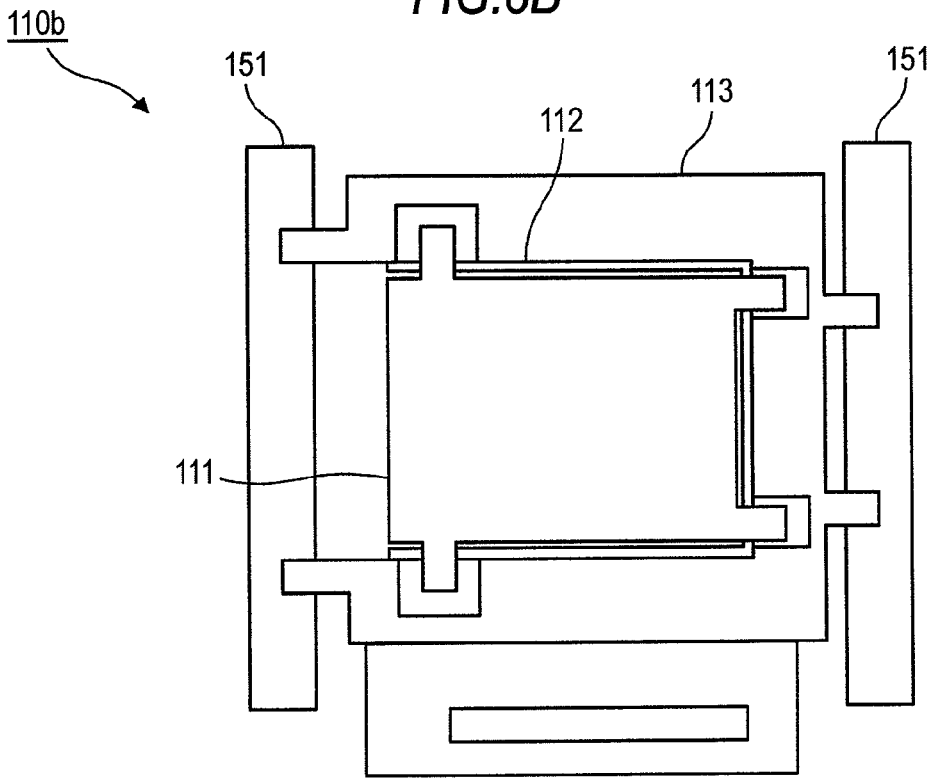

FIG. 8 is a diagram showing variations of the large-capacity stacking unit 110.

By preparing a large-capacity stacking unit 110 matched with the sheet size, the user can use the large-capacity stacking unit 110 adaptable to the size of the sheet on which an image is formed. That is, by preparing a first large-capacity stacking unit 110*a* having a sheet stacking member 111, a container frame 112 and a support member that are adaptable to A4-size sheets and a second large-capacity stacking unit 110*b* having a sheet stacking member 111, a container frame 112 and a support member that are adaptable to A3-size sheets as shown in FIG. 8, the user can select which one of the large-capacity stacking units 110 should be used.

When the container frame 112 is provided, the controller 200 may change the maximum number of stackable sheets or the stackable sheet height according to the size of the container frame 112.

When the size of the sheets stacked in the sheet stacking apparatus 100 is larger, the weight per one sheet is heavier than that when the sheet size is smaller. Therefore, from the viewpoint of easiness of carrying, the maximum number of stackable sheets may be set to a smaller value or the maximum stackable sheet height may be set to a lower value in the case of the larger size of the sheet (stacked in the sheet stacking apparatus 100) than in the case of the smaller size of the sheet.

Therefore, the controller 200 may recognize the size of the mounted container frame 112, and change the maximum number of stackable sheets or the stackable sheet height in accordance with the size of the recognized container frame 112. The size of the container frame 112 may be recognized based on whether the container frame 112 is detected by a container size detecting sensor 130 (see FIG. 1) described later, for example. In this case, the container size detecting sensor 130 functions as an example of a recognizing unit for recognizing the size of the container frame 112.

In order to implement the above control, the container size detecting sensor 130 (see FIGS. 1 and 2) as an optical sensor for detecting the size of the container frame 112 is further provided at the lower portion of the sheet stacking apparatus 100, and a signal from the container size detecting sensor 130 is input into the CPU 201 through the input interface 204 of the controller 200. Accordingly, when the container presence or absence detecting sensor 120 detects existence of the container frame 112 and also the container size detecting sensor 130 detects the container frame 112, the controller 200 can recognizes that the size of the installed container frame 112 is a larger size (for example, A3-size). On the other hand, when the container presence or absence detecting sensor 120 detects existence of the container frame 112, but the container size detecting sensor 130 does not detect the container frame 112, the controller 200 can recognize that the size of the installed container frame 112 is a smaller size (for example, A4-size).

Furthermore, when the controller 200 recognizes that the size of the installed container frame 112 is the larger size, the controller 200 stops the image forming operation at to stage where the first height detecting sensor 121*a* detects the height of the support member 113. On the other hand, when the controller 200 recognizes that the size of the installed container frame 112 is the smaller size, the controller 200 stops the image forming operation at a stage where the third height detecting sensor 121*c* detects the height of the support member 113.

Another sheet stacking processing executed by the controller 200 will be described with reference to a flowchart of FIG. 9.

Figure 9:
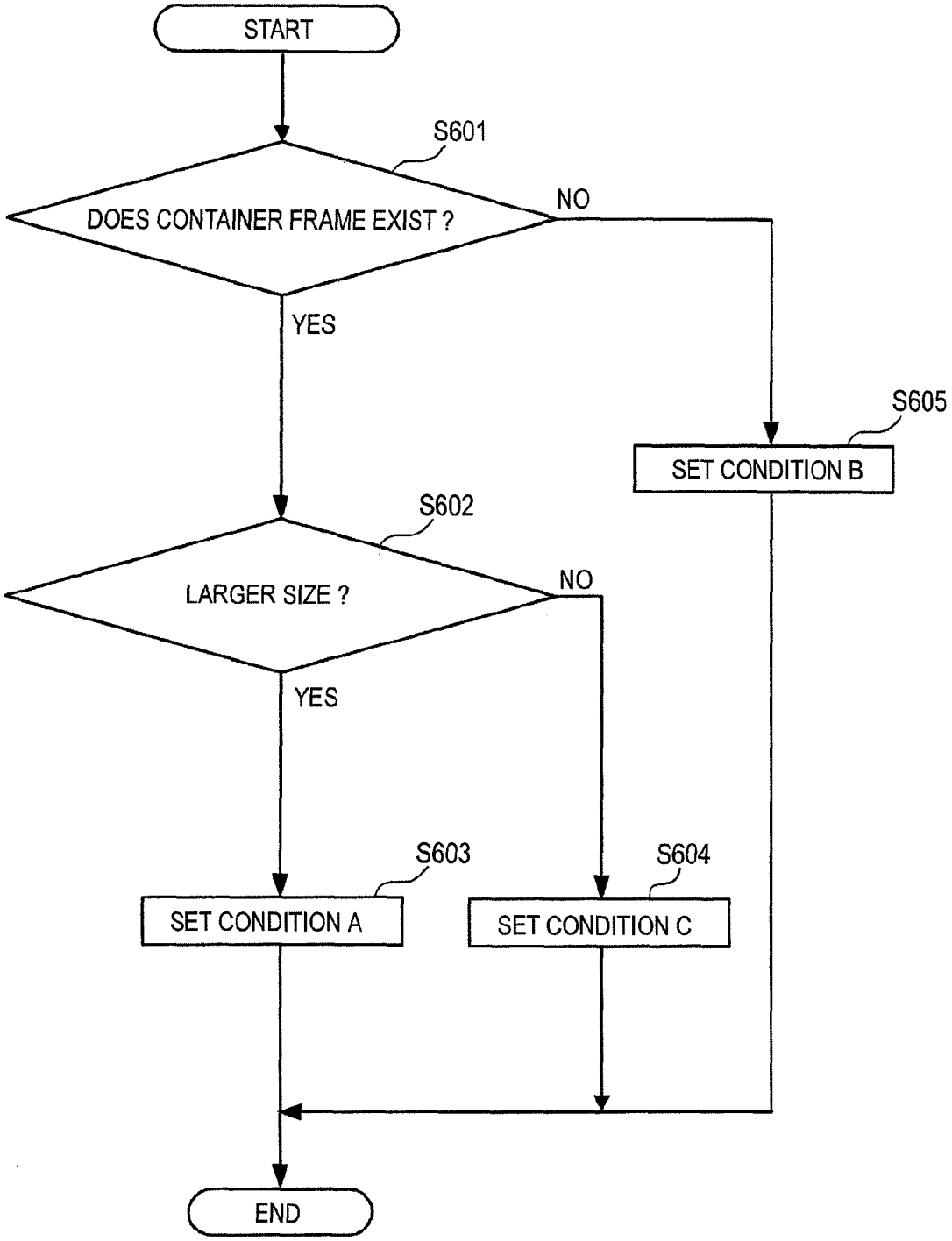
FIG. 9 is a flowchart showing a procedure of another sheet stacking processing executed by the controller.

FIG. 9 is a flowchart showing a procedure of another sheet stacking processing executed by the controller 200. The controller 200 executes the sheet stacking processing in response to an image forming request or the like as a trigger, for example by pushing the print start button.

The controller 200 first determines, on the basis of a detection result of the container presence or absence detecting sensor 120, whether the container frame 112 exists, or not (step 601). When it is determined in step 601 that the container frame 112 exists (i.e., "Yes"), the controller 200 determines whether the size of the container frame 112 is a larger size, or not (step 602).

When it is determined in step 602 that the size of the container frame 112 is the larger size (i.e., "Yes"), the controller 200 sets a condition A as the sheet stacking finishing condition (step 603). On the other hand, when it is determined in step 602 that the size of the container frame 112 is not the larger size (i.e., "No"), the controller 200 sets a condition C (step 604). When it is determined in step 601 that the container frame 112 does not exist (i.e., "No"), the controller 200 sets a condition B as the sheet stacking finishing condition (step 605). After setting the condition in step 603, 604 or 605, the controller 200 finishes the processing.

As described above, the condition A can indicate the situation in which the first height detecting sensor 121*a* detects the support member 113, and the condition B can indicate the situation in which the third height detecting sensor 121*c* detects the support member 113. Furthermore, the condition C can indicate the situation that the second height detecting sensor 121*b* detects the support member 113.

As described above, when the container frame 112 is provided, the controller 200 sets the sheet stacking finishing condition according to the size of the container frame 112, whereby the sheets can be stacked according to user's needs.

The controller 200 may change the maximum number of sheets to be continuously discharged to the large-capacity sheet stacking unit 110 according to the size of the installed container frame 112. For example, the controller 200 sets, to F (for example, 1,000 sheets), the maximum number of sheets to be continuously discharged to the large-capacity sheet stacking unit 110 when the container presence or absence detecting sensor 120 detects existence of the container frame 112 and also the container size detecting sensor 130 detects the container frame 112. On the other hand, the controller 200 sets, to D (for example, 2,000 sheets), the maximum number of sheets to be continuously discharged to the large-capacity sheet stacking unit 110 when the container presence or absence detecting sensor 120 detects existence of the container frame 112, but the container size detecting sensor 130 does not detect the container frame 112.

When the container presence or absence detecting sensor 120 detects existence of the container frame 112 and also the container size detecting sensor 130 detects the container frame 112, the controller 200 stops the image forming operation at a stage in which the number of sheets discharged continuously from the discharge roller 105 reaches F. On the other hand, when the container presence or absence detecting sensor 120 detects existence of the container frame 112, but the container size detecting sensor 130 does not detect the container frame 112, the controller 200 stops the image forming operation at a stage in which the number of sheets discharged continuously from the discharge roller 105 reaches D.

Alternatively, in a case where the user inputs the number of sheets from the operation panel 23, when the container presence or absence detecting sensor 120 detects existence of the container frame 112 and also the container size detecting sensor 130 detects the container frame 112, the controller 200 may accepts only F or less (i.e., the acceptable upper limit number is equal to F). Furthermore, when the container presence or absence detecting sensor 120 detects existence of the container frame 112, but the container size detecting sensor 130 does not detect the container frame 112, the controller 200 may accept only D or less (i.e., the acceptable upper limit number is equal to D).

In the case where the maximum number of stackable sheets are set to a smaller value or the maximum stackable sheet height is set to a lower value in the case of installation of the container frame 112 in the large-capacity sheet stacking unit 110 than that in the case of non-installation of the container frame 112 in the large-capacity sheet stacking unit 110, the controller 200 may execute the following control.

When the number or height of sheets which has been subjected to the image forming operation reaches the set number or height of sheets at which the image forming operation is controlled to be stopped under the situation that the container frame 112 is installed, the controller 200 stops the image forming operation, and also displays on the operation panel 23 an icon which promotes the user to select whether the image forming operation should be continued or the stacked sheets is taken out. When the user selects to continue the image forming operation, the image forming operation is continued until a condition set by the user again is satisfied. On the other hand, when the user selects to take out the stacked sheets, the image forming operation is kept stopped.

On the basis of the user's operation of the operation panel 23, the controller 200 may recognize whether the container frame 112 is installed or not, and set the maximum number of stackable sheets or the maximum stackable sheet height in the sheet stacking apparatus 100 according to this recognition result. In this case, when the container presence or absence detecting sensor 120 does not detect existence of the container frame 112 although the user wants to select sheet stacking based on the container frame 112 by operating the operation panel 23, it may be displayed on the operation panel 23 or informed by sounding an alarm buzzer that the container frame 112 is not installed.

Furthermore, the controller 200 may set the maximum stackable sheet number or the maximum stackable sheet height on the assumption of use of the container frame 112 by default. In this case, when the container presence or absence detecting sensor 120 does not detect existence of the container frame 112 in spite of an instruction of the image forming operation, it may be displayed on the operation panel 23 or informed by sounding an alarm buzzer that the container frame 112 is not installed.

Figure 10A:
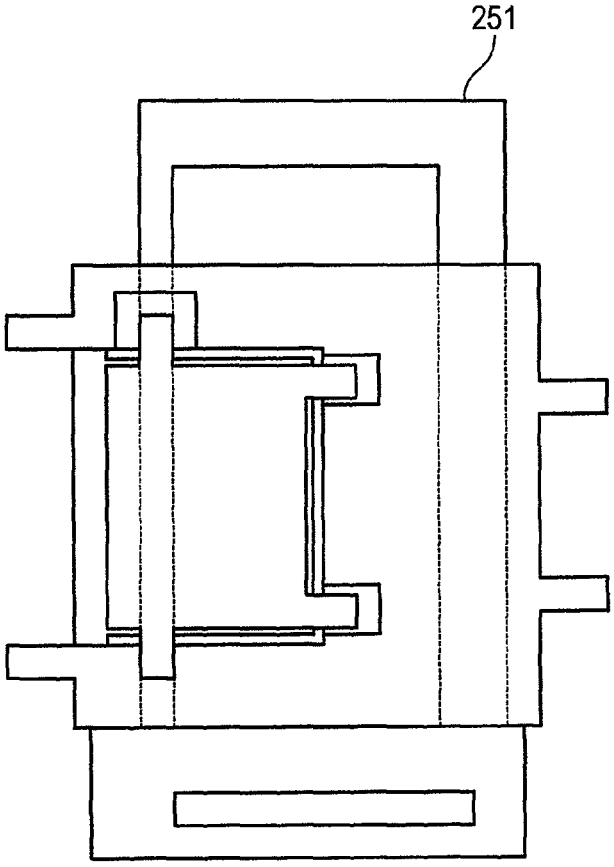
FIGS. 10A and 10B are diagrams showing another shape of the elevator arm of the elevator apparatus.
Figure 10B:
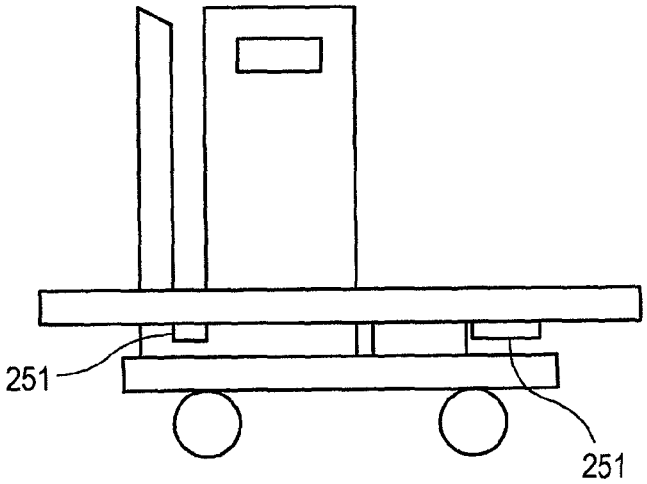

FIG. 10 is a diagram showing another shape of the elevator arms 151 of the elevator device 150.

A forklift type elevator arm 251 as shown in FIG. 10 may be used. By using the elevator arm 251 configured as described above, the size of the large-capacity sheet stacking unit 110 in the sheet transporting direction can be reduced. Furthermore, when the elevator arm 251 is used, the extension portions 113*d* of the support member 113 are not required, and thus the size of the large-capacity sheet stacking unit 110 is further reduced by omitting the extension portions 113*d*.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the skilled in the art to understand the invention for various embodiments and with the various modifications as are suited to the particular use contemplated. It is intended that the scope of the invention be defined by the following claims and their equivalents.

What is claimed is:

1. A recording medium stacking apparatus, comprising:

a stacking member having a stacking surface on which a recording medium transported from an image forming unit is stacked;

an outside member that is located at the outside of the stacking surface and extends in a substantially vertical direction to the stacking surface; and a support member including a support portion that supports the stacking member, the support member being detachable from the outside member while supporting the stacking member, wherein the stacking member has an extension portion extending from the stacking surface, and wherein the support portion of the support member supports the extension portion of the stacking member and restricts movement of the extension portion of the stacking member, wherein the support member is formed as a plate-shaped member, and the support portion of the support member is a recessed portion being concaved inward from an upper surface of the support member, and the extension portion is received in the recessed portion of the support member.

2. The recording medium stacking apparatus according to claim 1, wherein the outside member restricts movement of the recording media stacked on the stacking surface of the stacking member, and wherein the support member further includes a restriction portion that restricts movement of the outside member.

3. The recording medium stacking apparatus according to claim 1, wherein the outside member has an inner support portion that supports the extension portion of the stacking member inside the support member, and the inner support portion supports the extension portion of the stacking member to allow the stacking member and the support member to be separable from each other.

4. The recording medium stacking apparatus according to claim 3, wherein the outside member and the support member are mountable on a carriage, wherein the support member is vertically movable while supporting the stacking member in a state where the outside member is mounted on the carriage, and wherein the outside member is separable from the support member while supporting the stacking member in a state that the support member is mounted on the carriage.

5. The recording medium stacking apparatus according to claim 1, wherein the outer member has at least one grip portion being formed as a hole in a side wall of the outer member.

* * * * *